United States Patent [19]

Bonvoisin

[11] 4,422,798

[45] Dec. 27, 1983

[54] PROCESS FOR CONSTRUCTION OF AN UNDERGROUND STRUCTURE AND THE STRUCTURE THUS OBTAINED

[75] Inventor: Jacques Bonvoisin, Beaufoy, Belgium

[73] Assignee: Compagnie Internationale des Pieux Armes Frankignoul, Liege, Belgium

[21] Appl. No.: 260,995

[22] Filed: May 6, 1981

[30] Foreign Application Priority Data

May 8, 1980 [BE] Belgium ..... 0/200526

[51] Int. Cl.[3] ..... E21D 9/04

[52] U.S. Cl. ..... 405/132; 405/138; 405/184

[58] Field of Search ..... 405/139, 140, 138, 147, 405/134, 135, 148, 145, 151, 146, 152, 153, 150, 184

[56] References Cited

U.S. PATENT DOCUMENTS

| | | | |
|---|---|---|---|
| 2,325,565 | 7/1943 | Williams | 405/184 |
| 2,377,012 | 5/1945 | Jacobs | 405/139 |
| 3,631,680 | 1/1972 | Thomson | 405/139 |
| 3,968,655 | 7/1976 | McGlothlin | 405/138 X |
| 4,139,320 | 2/1979 | Ueno et al. | 405/138 |

FOREIGN PATENT DOCUMENTS

| | | | |
|---|---|---|---|
| 2507984 | 9/1976 | Fed. Rep. of Germany | 405/139 |
| 1335954 | 7/1963 | France | 405/184 |

*Primary Examiner*—Dennis L. Taylor

*Attorney, Agent, or Firm*—Brumbaugh, Graves, Donohue & Raymond

[57] ABSTRACT

An improved process for the construction of an underground structure, such as a tunnel, as well as the structure thus obtained, are disclosed. A first longitudinal underground passage comprising a series of mechanically resistant pipes is sunk into the soil and a vertical trench is dug beneath the first passage from openings provided in the bottom of the first passage. This trench is filled with concrete and defines a first lateral wall of the structure. Lateral openings in the first passage also are provided, through which another series of mechanically resistant pipes is horizontally driven to form the roof of the structure. A second vertical wall is thereafter formed from a second vertical trench to form a second lateral wall of the structure. Alternatively, first and second longitudinal passages and vertical walls may be constructed simultaneously, and the roof pipes driven from one or both of the longitudinal passages.

8 Claims, 3 Drawing Figures

PROCESS FOR CONSTRUCTION OF AN UNDERGROUND STRUCTURE AND THE STRUCTURE THUS OBTAINED

BACKGROUND OF THE INVENTION

The invention concerns a process for construction of an underground structure, particularly a tunnel, a subway station, in particular in loose soil, as well as the structure thus obtained.

It is already known, particularly from Belgian Pat. No. 864.136 filed by the applicant, to construct such structures by means of excavations which are timbered and covered with concrete constituting the vertical walls of the structure and of pipes driven into the soil parallel to said walls and intended to form the roof of the latter.

In another process the pipes forming the roof are driven perpendicular to the longitudinal axis of the structure and consequently perpendicular to the vertical walls.

In the present state of the art these pipes are driven starting from a longitudinal gallery made by the known process of digging and shoring.

These processes present certain disadvantages. Particularly, the construction putting these processes into practice can prove to be relatively long. Besides, settling can be produced in the foundations of houses or at the level of the surface installations such as roads, railroads, under which the structure is constructed. Finally, the known processes pose problems concerning the safety of the works.

SUMMARY OF THE INVENTION

The present invention has the object of avoiding these disadvantages and of simplifying and speeding up the construction of such underground structures.

For this purpose, the invention proposes a process for construction of an underground structure, of the type comprising the construction of a first longitudinal underground passage; the construction of a first lateral wall, preferably of concrete, in a vertical direction and defining a first lateral side of said structure, this wall being obtained by filling a trench dug from said first passage; the sinking of a series of first mechanically resistant pipes in the soil leading from said passage, preferably horizontal and perpendicular to the plane of said trench, said pipes being intended to form the roof of said structure; the construction before or after said sinking of a second underground passage parallel to the first and adjacent said first pipes; the construction in an analogous manner to the first of a second lateral wall in a vertical direction and defining another lateral side of said structure; the covering with concrete of said passages and said pipes; said process being characterized in that it consists of constructing at least one of said passages by means of a series of second mechanically resistant pipes, sunk into the soil, finally digging the above-mentioned trenches from first openings provided on the lower side of said second pipes and forcing said first pipes from second openings provided on a lateral side of said second pipes.

According to a particular embodiments of the invention, the process consists of constructing, as the second passage, a shored gallery situated under said first pipes, said gallery being constructed after the sinking of said first pipes, said pipes being driven sufficiently far to serve as protection for the digging of said gallery.

According to another embodiment of the invention, the process consists of constructing both of the above-mentioned passages by means of said second pipes, preferably at the same time, then carrying out the sinking of said first pipes either from a single one of said passages or from both.

BRIEF DESCRIPTION OF THE DRAWINGS

The invention will be better understood and other objects, characteristics, details and advantages of the invention will appear more clearly from the explanatory description which follows with reference to the attached schematic drawings presented only by way of example illustrating two embodiments of the invention and in which.

DESCRIPTION OF EXEMPLARY EMBODIMENTS

Figure 1:
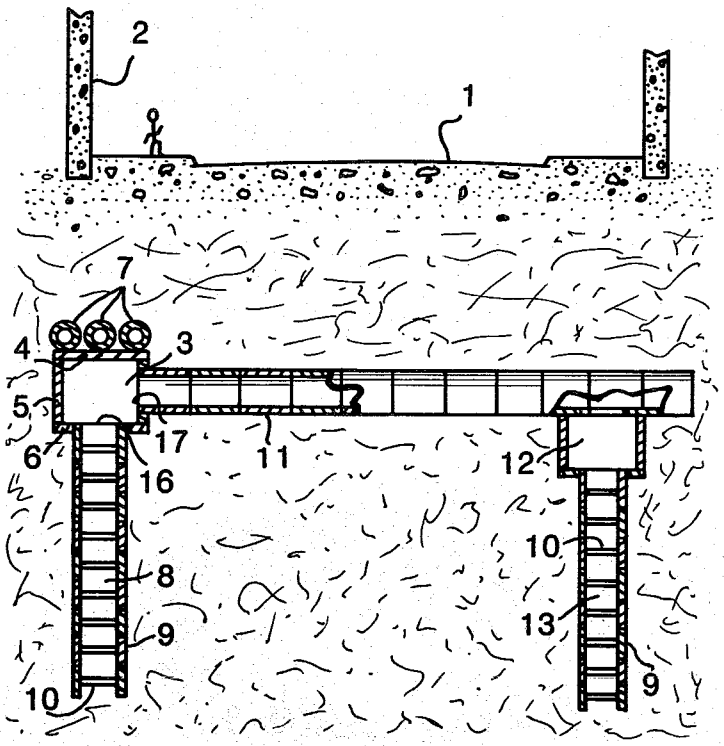
Fig. 1 PRIOR ART
FIG. 1 represents schematically a view in vertical cross-section, illustrating a construction stage of a tunnel according to the prior art.

First the prior art will be described with reference to FIG. 1, in order to make the invention better understood and the advantages which it provides compared to this art.

Reference 1 designates the surface of the soil, for example a road in an urban zone, surrounded by structures 2. The person outlined is given as indicative of the scale.

The prior art consists of digging, starting from an access shaft, a horizontal gallery 3, which is shored at 4, 5 and 6 in a known manner. This gallery can be dug under the protection of driven pipes of small diameter 7. The gallery 3 has sufficient dimensions to permit the movement of workers and execution of all the necessary work, in particular the digging of a vertical trench 8.

This trench is encased as it is being dug with rigid plates 9 and elements 10 of a known type.

Then, stating from gallery 3, a series of pipes 11 is sunk, preferably horizontally and perpendicular to the plane of the trench 8 by known means, such as hydraulic jacks. After installation of the pipes, the ground which is on the inside of the tubular passage thus formed can be excavated and then removed. Finally, the pipes wil be reinforced and covered with concrete and they will thus form the roof of the tunnel. Connecting elements, of a type known per se, will be able to be installed to to join rigidly the lines of parallel pipes.

Then a second longitudinal horizontal gallery 12 is dug parallel to gallery 3. This gallery will also be shored. Pipes 11 are driven sufficiently far to serve as protection for the digging of this gallery. Then one proceeds to the digging and lining of trench 13 in a manner completely analogous to that used for the construction of trench 8. Then the two trenches 8 and 13 will be filled, preferably with concrete, so as to form two vertical lateral walls defining the two lateral sides of the tunnel. Galleries 3 and 12 will also be covered with concrete.

Of course, then one proceeds with the excavation and the removal of the dirt contained in the volume defined by the lateral walls obtained by filling trenches 8 and 13 and by pipes 11.

This known procedure presents the disadvantages which have been mentioned above, in particular, it can occasion considerable settling in the vicinity of gallery 3.

Now the process of the invention which overcomes the disadvantages of the prior art will be described with reference to the following figures.

Figure 2:
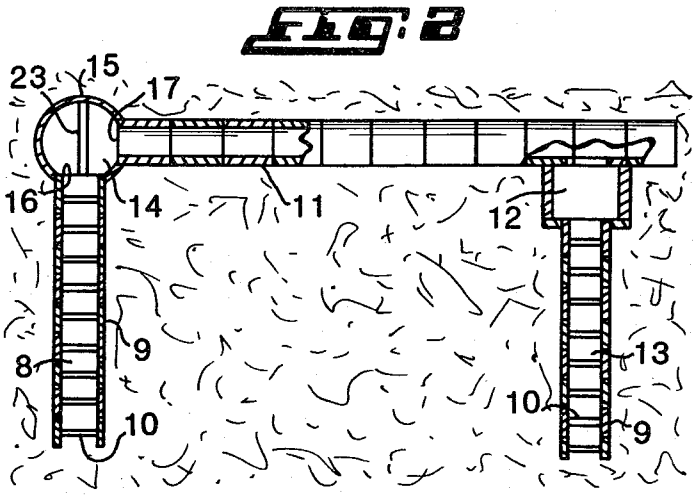
FIG. 2 is a view in vertical cross-section illustrating a construction stage of a tunnel according to a first embodiment of the process of the invention.

Considering more particularly FIG. 2, it can be seen that, according to the process of the invention, the shored gallery 3 is replaced by a tubular passage 14, preferably cylindrical, formed from a series of second mechanically resistant pipes 15 and which have been sunk into the soil, preferably horizontally. In order to do this, as in the formation of the shored gallery, an access shaft has been dug from the surface of the soil to the desired level. Pipes 15 have been driven or sunk horizontally into the soil with jacks, for example. Then, one proceeds in an identical manner to that which has just been described. One has employed in FIG. 2 the same reference numerals to represent identical elements to those employed in FIG. 1. In order to do this, holes are cut on the lower side of pipes 15 and from these holes the trench 8 is dug which will be encased and then covered with concrete. In addition, holes 17 are cut on a lateral side of pipes 15 for the driving and sinking of pipes 11. One will then proceed with the digging of a gallery 12 and a trench 13.

The pipes used for the construction of passages 14 are preferably of a type similar to pipes 11, that is to say made of an appropriate mechanically resistant material, for example steel, reinforced concrete, prestressed concrete, asbestos cement, plastic material. Pipes 15 will have a diameter such that the obtained passage 14 may permit the movement of workers and the carrying out of necessary operations.

The construction of passage 14 from pipes 15 offers numerous advantages. In particular, it does away with all the manual labor which was necessary before for the digging and the framing and shoring of gallery 3. Moreover, pipes 15 offer very high security so that one can do without the protective pipes 7 which were used in the known method. In addition, settling in the vicinity of passage 14 is considerably reduced so that the process of the invention can be put into use at a relatively small depth with respect to the level of the soil and, in any case, clearly less than that required by the prior art.

Another essential characteristic of the process of the invention resides in the fact that passage 14 formed starting from pipes 15, serves at the same time as a starting gallery for execution of the encased trench 8 and for the driving of pipes 11, whereas in the known process, starting with the driven pipes one could only at the most carry out the digging of the trenches intended for the construction of the lateral walls of the structure. This characteristic permits greatly simplifying the construction of this structure.

Figure 3:
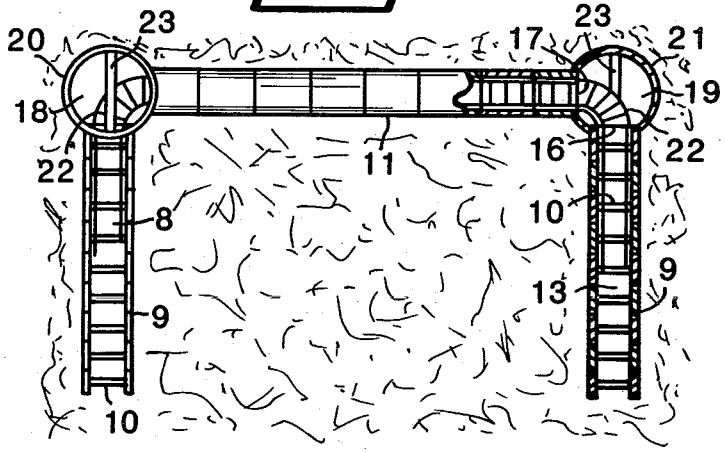
FIG. 3 is a vertical cross-section illustrating a construction stage of a tunnel according to a second embodiment of the process of the invention.

Now a second embodiment of the invention will be described making particular reference to FIG. 3. According to this embodiment, two passages 18 and 19 are constructed starting from pipes 20 and 21, of the same type as pipes 15 described in the case of FIG. 2. Preferably, the two passages 18 and 19 will be parallel and disposed in the same horizontal plane. According to a preferred embodiment of the invention, the construction of passages 18 and 19 takes place at the same time, by simultaneous driving of series of pipes 20 and 21 intended to form these passages, this before the driving of transverse pipes 11.

One then proceeds from openings made on the lower side of pipes 20 and 21 to the digging of trenches 8 and 13 then to their lining with above-mentioned elements 9 and 10. Pipes 11 will be able to be driven either beginning from pipe 18 or from both pipes 18 and 19, in which case pipes 21 will have sufficient dimensions, at least equal to those of pipes 20.

In this case where pipes 11 are driven starting from a single passage, for example passage 18, one will be able to mark the contact perimeter between pipes 11 and pipes 21 by slots made in said pipes 21 with an oxyhydrogen blowtorch. When the contact has been established, in particular after the covering with concrete of pipes 11, one will then be able to cut from passage 19 the portion of the wall of pipe 21 separating this pipe from adjacent pipe 11. For this purpose one will be able to use the marks made in the manner described above.

The sealing between pipe 21 and pipe 11 will be able to be assured by means of a sheath of appropriate form and/or by the injection of a caulking material.

One will also be able to place connecting trusses 22, of a known type, between the roof of the structure, particularly pipes 11 and the lining of the trenches 8 and 13.

In addition, pipes 20 or 21 will be able to be reinforced by arches or studs 23 located on both sides of openings cut in these pipes in particular for digging of vertical trenches and the driving of pipes 11. Of course, pipes 15 utilized for carrying out the first embodiment of the process of the invention, which has been described with reference to FIG. 2, will be able to be provided in the same way with analogous arches and studs.

The process which has just been described, utilizing two symmetrical passages constructed of driven pipes is particularly advantageous. In fact, this process considerably lessens the construction time, in particular it permits carrying out the work in a symmetrical manner. In addition, it offers the possibility of establishing a continuous frame connecting the vertical walls and the roof by means of pipes 20 and 21 thus providing a perfect symmetrical fitting between these walls and the roof.

Of course, the invention is not at all limited to the embodiments described and represented which have been given only by way of example. In particular, it comprises all means constituting equivalent techniques of the means described as well as their combinations if the latter are carried out according to its spirit and put into operation within the framework of the protection as claimed.

I claim:

1. Process for the construction of an underground structure, particularly a tunnel, of the type comprising:

the construction of a first longitudinal underground passage;

the construction of a first lateral wall, preferably of concrete, in a vertical direction and defining a first lateral side of said structure, this wall being obtained by filling a trench dug from said first passage;

driving a series of first mechanically resistant pipes into the soil from said passage, preferably horizontally and perpendicular to the plane of said trench, said pipes being intended to form the roof of said structure;

construction before or after the said driving, of a second underground passage parallel to the first and adjacent to said first pipes;

construction, in an analogous manner to the first, of a second lateral wall, in a vertical direction and defining another lateral side of said structure;

covering with concrete of said passages and said pipes;

said process being characterized in that it consists of constructing at least one of said passages by means of a series of second mechanically resistant pipes, driven into the soil; then digging said trenches from first openings provided on the lower side of said second pipes and in driving said first pipes from second openings provided on a lateral side of said second pipes.

2. Process according to claim 1, characterized in that it consists of constructing, as a second passage, a shored gallery situated under said first pipes, said gallery being constructed after the driving of said first pipes, and said pipes being driven sufficiently far to serve as protection in the digging of said gallery.

3. Process according to claim 1, characterized in that it consists of constructing the two passages both by means of said second pipes, preferably at the same time, then in carrying out the driving of the series of said first pipes either from one of said passages or from both.

4. Process according to claim 1, characterized in that it consists in locating connecting trusses between the roof of the structure particularly said first pipes and the vertical walls.

5. Process according to claim 1, characterized in that it consists in marking the perimeter of contact between said first and said second pipes by slots made in said second pipes, for example by oxyhydrogen blowtorch.

6. Process according to claim 1, characterized in that it consists in ensuring the tightness of contact between said first and said second pipes by means of a sheath and/or injection of a caulking material.

7. In an underground structure, particularly a tunnel, of the type comprising:

a first longitudinal underground passage;

a first lateral wall, preferably of concrete, extending in a vertical direction from said first longitudinal underground passage and defining a first lateral side of said structure formed by filling a first trench dug from said first longitudinal underground passage;

a series of first mechanically resistant pipes, driven into the soil from said first longitudinal underground passage, preferably horizontally and perpendicular to the plane of said first trench, said first pipes defining the roof of said structure;

a second longitudinal underground passage parallel to said first longitudinal underground passage and adjacent to said first mechanically resistant pipes;

a second lateral wall analogous to said first lateral wall; and a covering of concrete on said passages and said pipes, the improvement wherein:

at least one of said first and second longitudinal underground passages comprises a series of second mechanically resistant pipes driven into the soil, said trenches being dug from first openings provided on a lower side of said second mechanically resistant pipes, said first mechanically resistant pipes being driven through second openings in a lateral side of said second mechanically resistant pipes.

8. The underground structure according to claim 7, characterized in that connecting trusses are provided in said first longitudinal underground passage between said first pipes and said vertical walls.

* * * * *